US005937238A

United States Patent [19]

Tremblay et al.

[11] Patent Number: 5,937,238

[45] Date of Patent: Aug. 10, 1999

[54] SLOTTED CLIP FOR USE IN THE REASSEMBLY OF PRINTER TONER CARTRIDGES

[75] Inventors: Roger Tremblay, Merrimack; Thomas Pelletier, Nashua; Joseph Jean, Jr., Epping, all of N.H.

[73] Assignee: Nashua Corporation, Nashua, N.H.

[21] Appl. No.: 08/984,341

[22] Filed: Dec. 3, 1997

Related U.S. Application Data

[60] Provisional application No. 60/032,351, Dec. 4, 1996.

[51] Int. Cl.[6] ..... G03G 15/00

[52] U.S. Cl. ..... 399/109

[58] Field of Search ..... 399/103, 106, 399/109; 156/94

[56] References Cited

U.S. PATENT DOCUMENTS 5,267,003 11/1993 Grappiolo ..... 399/109

5,525,183 6/1996 Baley ..... 156/94 X 5,531,846 7/1996 Miraglia et al. ..... 399/109 X

*Primary Examiner*—S. Lee

*Attorney, Agent, or Firm*—Dike, Bronstein, Roberts & Cushman, LLP; George W. Neuner

[57] ABSTRACT

Methods of recycling printer cartridges use special rail-type clips for reassembly of complementary halves of a printer cartridge, the clips comprising cutouts or gaps spaced along the length thereof which accommodate protrusions near the edges being joined. The invention allows for recovering these cartridges and avoiding the cost of discarding a fairly costly machine element while additionally avoiding the processing costs for rendering the cartridge into inert, non-polluting waste.

18 Claims, 2 Drawing Sheets

SLOTTED CLIP FOR USE IN THE REASSEMBLY OF PRINTER TONER CARTRIDGES

CROSS REFERENCE TO RELATED APPLICATIONS

This application claims the priority to U.S. Provisional Patent Application No. 60/032,351, filed Dec. 4, 1996, the entire disclosure of which is incorporated herein by reference.

BACKGROUND OF THE INVENTION

Many toner cartridges available for laser printers contain significant mechanical elements employed in the electrophotographic printing process which are subject to wear or failure. By incorporating such elements in the toner cartridge, this has reduced the need for service calls to outside technicians by alleviating the need to repair these printer elements, since these elements are replaced on a regular basis when a new toner cartridge is installed. The increased complexity of these "all-in-one" cartridges and the concomitant increase in the value of these cartridges (due to the complexity of the incorporated mechanical elements) has resulted in substantially increased efforts towards collection and remanufacture of exhausted toner cartridges.

Several approaches to remanufacturing these cartridges are currently being practiced. These methods typically incorporate a method of sealing the toner supply portion of the cartridge to prevent toner leakage during shipment. These seals are then removed by the printer operator when installing the cartridge into the printer. One method currently in use to seal the toner supply portion of the cartridge is to insert a seal through the original seal removal slot. A second method currently in use involves splitting the toner supply portion of the cartridge apart from the portion of the cartridge that contains the mechanism for tribo-charging and delivering charged toner to the photoreceptor (where the latent xerographic image is transformed to a visible image through the well-known xerographic process). With these two portions of the cartridge physically separated from each other, the toner supply sealing face is exposed, facilitating the installation of a new toner seal.

After recharging the toner cartridge, the assembly is resealed and reassembled. One known method of reassembly is to reconnect the toner hopper to the toner charging and delivery section using spring clips. These clips may be in the form of a plurality of short clips spaced along the sections to be joined, or in the form of two long clips (each individual clip situated on opposing flanges on each side of the respective members being joined). The long clip approach is preferable for several reasons: (1) the short clips represent a hazard to the printer since a single short clip, if it becomes disengaged, can fall into the paper transport region of the printer where it can cause significant damage to the mechanism; (2) the short clips present a plurality of protruding edges that can cause injury to a person handling the cartridge; and (3) the long clips present a more uniform clamping pressure and a more pleasing appearance, in comparison to the short clips.

Several cartridge models available today, such as those based on the Canon WX engine, including the Hewlett Packard LaserJet 5si, are not amenable to the use of long clips, due to the protrusion of obstacles into the area of the mating flanges, which prevent the long clips from being fully installed along the flange edge. These obstacles typically consist of reinforcing ribs or similar protrusions molded into one or both of the mating flanges of the two members being joined.

BRIEF SUMMARY OF THE INVENTION

A unique rail-type clip is presently disclosed which may be employed in the reassembly of complementary halves of a printer cartridge during remanufacture of the cartridge. The u-shaped clips have openings, e.g., cutouts or gaps, in predetermined locations along the length of the gripping members of the clips, which accommodate protrusions near the edges being joined, and thus permit the clip to be fully mounted on the edge.

In an embodiment, the clip is generally u-shaped in cross section and comprises a rail-type assembly having a spine and two opposed gripping members integral with the spine. At least one of the gripping members have one or more openings formed therein, to accommodate protrusions integral with the printer cartridge flange or flanges. In a preferred embodiment this clip is a one-piece assembly. The clip may be molded from a resilient material such as plastic, or fabricated as a metal clip.

BRIEF DESCRIPTION OF THE SEVERAL VIEWS OF THE DRAWING

These and further features of the invention will be better understood with reference to the accompanying specification and the drawings, in which.

DETAILED DESCRIPTION OF THE INVENTION

Figure 1:
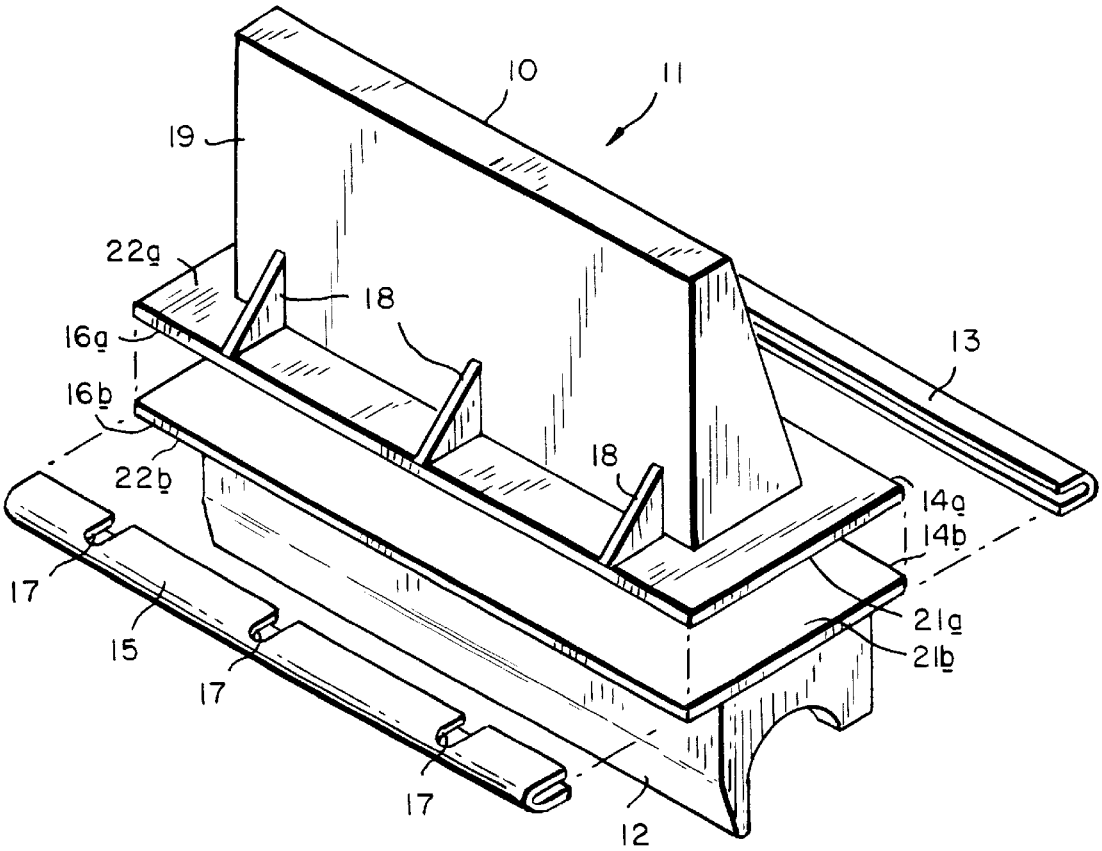
FIG. 1 is an exploded view of a typical printer cartridge and illustrates the use of the presently disclosed slotted rail clips.

FIG. 1 illustrates in exploded view a printer cartridge assembly 10 comprising upper portion 11 which, when originally manufactured, is mated to lower portion 12. In this embodiment, upper portion 11 comprises a toner hopper 19, and lower portion 12 comprises the toner charging and delivery apparatus (not shown). Both upper portion 11 and lower portion 12 feature flanges 22*a* and 22*b* which seal against each other to allow toner to pass from toner hopper 19 to lower portion 12 via openings (not shown) formed in flange faces 21*a* and 21*b*, respectively, the openings forming a fluid communication path. (When the cartridge is originally manufactured, this path is blocked by the aforementioned seal (not shown), which is removed by the operator before use.)

Flanges 22*a* and 22*b* further comprise generally parallel edges 16*a* and 16*b*; and 14*a* and 14*b*. As can be seen in FIG. 1, edges 14*a* and 14*b* may be joined by means of conventional rail-type clip 13. However, flange 22*a* includes a plurality of reinforcing ribs 18 along edge 16*a* which would otherwise obstruct and prevent installation of the conventional clip as 13 on edges 16*a* and 16*b*.

To allow for the reassembly of the printer cartridge, presently disclosed clip 15 comprises openings 17, e.g., holes, cutouts, notches, slots or gaps, spaced along the length of one of the opposed surfaces of the clip, which align with and accommodate or fit around obstructions or protrusions near the cartridge edges being joined. The clips are appropriately notched or slotted, and aligned with the flanges. The clips are pressed into place such that the protrusions extend into at least some of the notched areas. Not all of the openings in the clip need to be accommodated by protrusions; in another embodiment, the disclosed clip may have a regular or predetermined spacing of openings which can accommodate a number of different cartridges, i.e., with different arrangements of protrusions. Such notched clips may be made, for example, from formed metal strips or from extruded or molded plastic elements. The clips 15 may be adhered to the flanges strictly by the spring clamping force or may be additionally adhered by the incorporation of adhesive materials or fasteners. Additional notches may be present on the opposing edge of the clip if obstructions such as ribs 18 on the corresponding cartridge components would otherwise preclude installation of the clip 15.

In the recharging process, the printer cartridge halves are separated, in this embodiment, along the flange faces, and the necessary recharging and maintenance work is conducted. A new seal is then installed between the flange faces and the two halves are joined together. In this embodiment unslotted rail clip 13 is installed to sealably join complementary edges 14*a* and 14*b*, and slotted rail clip joins complementary edges 16*a* and 16*b*. Should it be desired to employ only a single clip in the remanufacture of a cartridge, however, the slotted clip 15 may be employed on both edges, i.e., in substitution for conventional clip 13.

It should be noted that the rail clips of the disclosure exemplified as 15 may also be used to reinforce or re-seal already assembled cartridges such as described herein. For example, if a cartridge such as cartridge 10 is assembled by some other method and is leaking toner along edges 22*a* and 22*b*, a clip 15 may be installed to (re)join those edges and stop the leak.

The incorporation of this method for remanufacturing a toner cartridge having obstructed flange faces represents a preferred method for recovering these cartridges and avoiding the cost of discarding a fairly costly element while additionally avoiding the processing costs for rendering the cartridge into inert, non-polluting waste. An additional benefit is that a cartridge remanufactured by this method is in a more amenable state for additional remanufacturing cycles after the original remanufacture in which this method is used, since the use of the clips allows for the cartridge to be readily disassembled and reassembled as necessary.

Figure 2A:
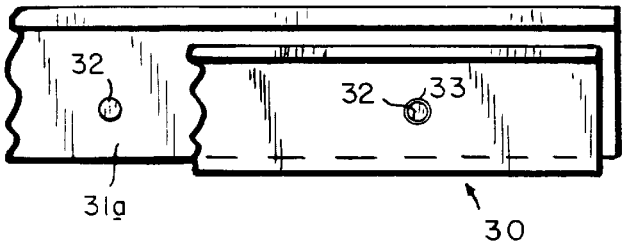
FIGS. 2A and 2B depict another embodiment in which a hole in the rail clip accommodates a post obstruction on the cartridge flange which functions as an anchor.
Figure 2B:
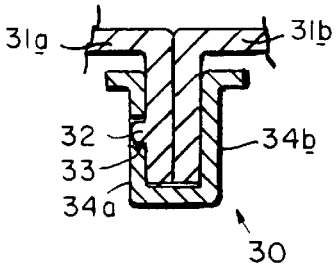

Alternatively, however, where it is desired to secure the reassembled cartridge in a manner that prevents inadvertent disassembly, or if it is desired to provide a tamper-proof assembly, the embodiments illustrated in FIGS. 2–4 may be employed. FIGS. 2A and 2B depict rail clip 30 attached to upper and lower flanges 31*a* and 31*b*, upper flange 31*a* further bearing obstructive posts or rods 32 along its length, which are accommodated by openings 33, in this case holes, along the length of upper gripping member 34*a* of rail clip 30, which also comprises lower gripping member 34*a*. When rail clip 30 is pushed into place, upper gripping member 34*a* is slipped over posts 32, the posts thus locking the rail clip onto the flanges. Further security may be obtained by providing (not shown) one or more posts provided on flange 31*b*, and openings on lower gripping member 34*b* for accommodating those posts.

Figure 3A:
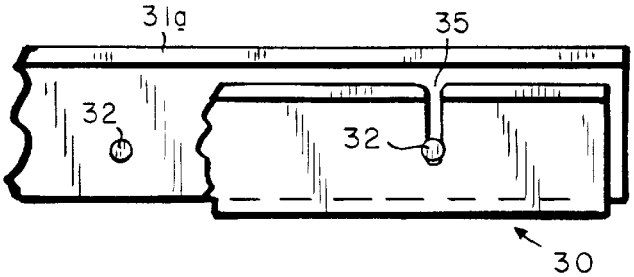
FIGS. 3A and 3B illustrate a variation on the embodiment of FIG. 2 wherein a slot in the rail clip comprises a post locking feature.
Figure 3B:
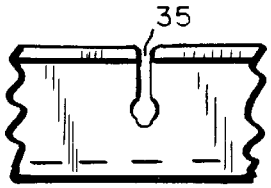

FIGS. 3A and 3B illustrate a variation on the embodiment shown in FIG. 2, wherein a slot 35 in the rail clip comprises semi-round portions for accommodating the posts 32. The clip fastens the flanges in the same manner as FIG. 2, except that slot 35 need not be passed over posts 32. The rail clip in this case may be made of a material which is compliant enough to allow the slot 35 to return to its original dimensions when installed.

Figure 4A:
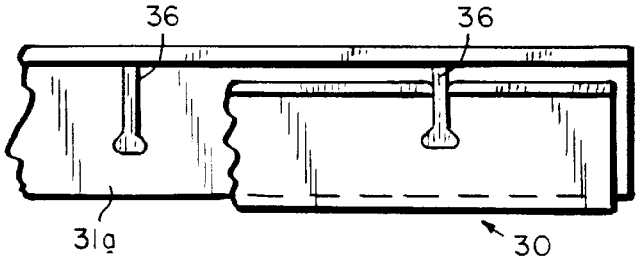
FIGS. 4A and 4B depict another post locking embodiment.
Figure 4B:
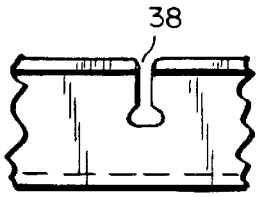

FIGS. 4A and 4B show another post locking embodiment, wherein ribs 36 having in cross section an expanded or flared edge 37 are accommodated by slots 38 of comparable geometry. In conjunction with the "locking-pin" embodiments such as shown in FIGS. 2–4, a further tamper-proof feature may include manufacturing the rail clip from a frangible material that allows installation of the clip but not its removal, i.e., the clip disintegrates if removal is attempted.

The foregoing description is meant to be illustrative of the invention. Other embodiments and variations will be apparent to those of ordinary skill in the art without departing from the inventive concepts contained herein. Accordingly, this invention is to be viewed as embracing each and every novel feature and novel combination of features present in or possessed by the invention disclosed herein and is to be viewed as limited solely by the scope and spirit of the appended claims.

We claim:

1. A method of sealing a printer cartridge flange, comprising the steps of:

a) providing a printer cartridge having at least first and second portions, wherein each of said portions includes a flange wherein said flanges are configured to be disposed in abutting relation when said at least first and second cartridge portions are mated; wherein each of said flanges includes an outer and an inner surface and a flange edge; wherein at least one of said flanges includes at least one obstructive member on said outer surface; and b) applying a rail clip to at least one of said outer surfaces, said rail clip comprising a spine and top and bottom gripping members, at least one of said gripping members comprising at least one opening(s) which accommodate at least of said one obstructive member.

2. The method of claim 1 wherein said rail clip is applied to first and second outer surfaces.

3. The method of claim 1 wherein said obstructive member is a reinforcing rib.

4. The method of claim 1 wherein said obstructive member is a post.

5. The method of claim 1 wherein said opening is a hole, cutout, notch, slot or gap.

6. The method of claim 3 wherein said obstructive member further comprises a flared edge.

7. The method of claim 1 wherein said rail clip is a formed metal strip; or an extruded or molded plastic element.

8. The method of claim 1 wherein said rail clip is made from a frangible material.

9. A method of refurbishing a printer cartridge comprising the steps of:

a) providing a printer cartridge having matable first and second portions, said first and second portions each including a flange having an inner and outer surface and a flange edge, wherein at least one of said flanges includes at least one obstructive member on said outer surface;

b) installing a seal between said inner surfaces;

c) mating said inner surfaces; and d) applying a rail clip to at least one of said outer surfaces, said rail clip comprising a spine and top and bottom gripping members, at least one of said gripping members comprising at least one opening(s) which accommodate at least of said one obstructive member.

10. The method of claim 9 wherein said obstructive member is a reinforcing rib.

11. The method of claim 9 wherein said obstructive member is a post.

12. The method of claim 9 wherein said opening is a hole, cutout, notch, slot or gap.

13. The method of claim 9 wherein said obstructive member further comprises a flared edge.

14. The method of claim 9 wherein said rail clip is made from a frangible material.

15. The method of claim 9 wherein said rail clip is a formed metal strip; or an extruded or molded plastic element.

16. An apparatus comprising a rail clip for securing first and second flanges of respective first and second printer cartridge portions wherein each of said flanges has a length and a flange edge, and wherein at least one end of said flanges includes at least one obstructive member extending from said flange, said rail clip having a u-shaped cross-section and comprising first and second gripping members, said rail clip also having a length approximating the length of at least one of said gripping members to accommodate said at least one obstructive member when said rail clip is disposed over said first and second flange edges so as to secure said first flange to said second flange.

17. The apparatus of claim 16 wherein said rail clip is a formed metal strip; or an extruded or molded plastic element.

18. The apparatus of claim 16 wherein said rail clip is made from a frangible material.

* * * * *